United States Patent [19]

Baumhauer, Jr. et al.

[11] 4,046,974

[45] Sept. 6, 1977

[54] ELECTROACOUSTIC TRANSDUCER WITH SPRINGS FORMING ELECTRICAL INTERCONNECTIONS AS A RESULT OF ASSEMBLY

[75] Inventors: John Charles Baumhauer, Jr.; Alex Michael Brzezinski; Joe Edward Warren; Stephen Reed Whitesell, all of Indianapolis, Ind.

[73] Assignee: Bell Telephone Laboratories, Incorporated, Murray Hill, N.J.

[21] Appl. No.: 728,604

[22] Filed: Oct. 1, 1976

[51] Int. Cl.[2] ..... H04R 19/00

[52] U.S. Cl. ..... 179/111 R

[58] Field of Search ..... 179/111 R, 111 E

[56] References Cited

U.S. PATENT DOCUMENTS

| | | | |
|---|---|---|---|
| 3,430,146 | 2/1969 | Chua | 179/111 R |
| 3,663,768 | 5/1972 | Madsen et al. | 179/111 E |
| 3,816,671 | 6/1974 | Fraim et al. | 179/111 E |

*Primary Examiner*—George G. Stellar
*Attorney, Agent, or Firm*—Harry L. Newman

[57] ABSTRACT

An electroacoustic transducer in accordance with the present invention comprises a perforated backplate having a plurality of upstanding parallel ribs between which conductive surfaces are situated. The conductive surfaces are electrically interconnected with one another and with a contact surface on a relieved shoulder at one end of the backplate. This shoulder is engaged by a bifurcated contact spring that (1) electrically connects the conductive surfaces to the input of an integrated preamplifier circuit deposited on a substrate and (2) holds the substrate in place on the underside of the backplate.

An electret diaphragm having a metallized surface is tensioned across the ribs of the backplate with the metallized surface facing away from the backplate, and while so tensioned, the ends of the diaphragm are clamped against the backplate by a conductive intermediate member that makes electrical contact with the diaphragm. The intermediate member is held in place by a conductive spring member that wraps around the sides of the foregoing assembly and presses the intermediate member and the substrate toward one another. The spring member provides the clamping force necessary to retain the desired tension on the diaphragm and at the same time further secures the substrate in place. In addition, the spring member includes a terminal that is located in engagement with the ground lead of the preamplifier circuit and thus in combination with the intermediate member provides a conductive path to ground for the conductive surface of the diaphragm. Finally, the spring member serves to provide additional electrostatic shielding for the electret.

12 Claims, 5 Drawing Figures

ELECTROACOUSTIC TRANSDUCER WITH SPRINGS FORMING ELECTRICAL INTERCONNECTIONS AS A RESULT OF ASSEMBLY

FIELD OF THE INVENTION

This invention relates to electroacoustic transducers and within that field to electret transducers.

BACKGROUND OF THE INVENTION

Electret transducers commonly comprise a permanently charged thin plastic film diaphragm that has one surface metallized and is tensioned in close proximity with a conductive backplate with the metallized surface remote to the backplate. The backplate is generally electrically connected to an amplifier circuit, and the metallized surface of the diaphragm is generally electrically connected to ground. While it is highly advantageous to establish these electrical connections as a consequence of the physical assembly of the components of the electret transducer, we are unaware of any electret transducer design other than that disclosed in Fraim et al U.S. Pat. No. 3,816,617 where this is accomplished.

Fraim et al U.S. Pat. No. 3,816,671 discloses an electret microphone including an apertured backplate having a peripheral ridge and a conductive surface within the ridge that extends through the apertures to the underside of the backplate. An electret diaphragm having an outwardly facing metallized surface is bonded to the peripheral ridge while under tension, and a conductive ring is positioned on the periphery of the diaphragm in engagement with the metallized surface. In addition, a closure plate having a preamplifier circuit thereon is positioned beneath the backplate, and a compressible conductive member that is bonded to the closure plate and electrically connected to the input of the preamplifier circuit, is positioned between the closure plate and the conductive surface on the underside of the backplate. A conductive housing disposed about these elements engages the conductive ring. The conductive housing is swaged against a conductive surface of the closure plate to connect the conductive ring to the ground lead of the preamplifier and to press the compressible conductive member against the conductive under-surface of the backplate.

SUMMARY OF THE INVENTION

While this arrangement may be satisfactory, the electret transducer of our design is believed to be an improvement thereover. An electret transducer in accordance with our invention comprises a preforated backplate having a plurality of upstanding parallel ribs between which conductive surfaces are situated. The conductive surfaces are electrically interconnected with one another and with a contact surface on a relieved shoulder at one end of the backplate. This shoulder is engaged by a bifurcated contact spring that (1) electrically connects the conductive surfaces to the input of an integrated preamplifier circuit deposited on a substrate, and (2) holds the substrate in place on the underside of the backplate.

An electret diaphragm is tensioned across the ribs of the backplate with the metallized surface of the diaphragm located on the side opposite to that in contact with the ribs. In addition, the ends of the diaphragm are clamped against the backplate by a conductive intermediate member that makes electrical contact with the diaphragm, a gasket being interposed between the diaphragm and the backplate.

The intermediate member is held in place by a conductive spring member that wraps around the sides of the foregoing assembly and presses the intermediate member and the substrate toward one another. The spring member provides the clamping force necessary to retain the desired tension on the diaphragm and at the same time further secures the substrate in place. In addition, the spring member includes a terminal that is located in engagement with the ground lead of the preamplifier and thus in combination with the intermediate member provides a conductive path to ground for the conductive surface of the diaphragm. Finally, the spring member serves to provide additional electrostatic shielding for the electret.

DETAILED DESCRIPTION

Figure 1:
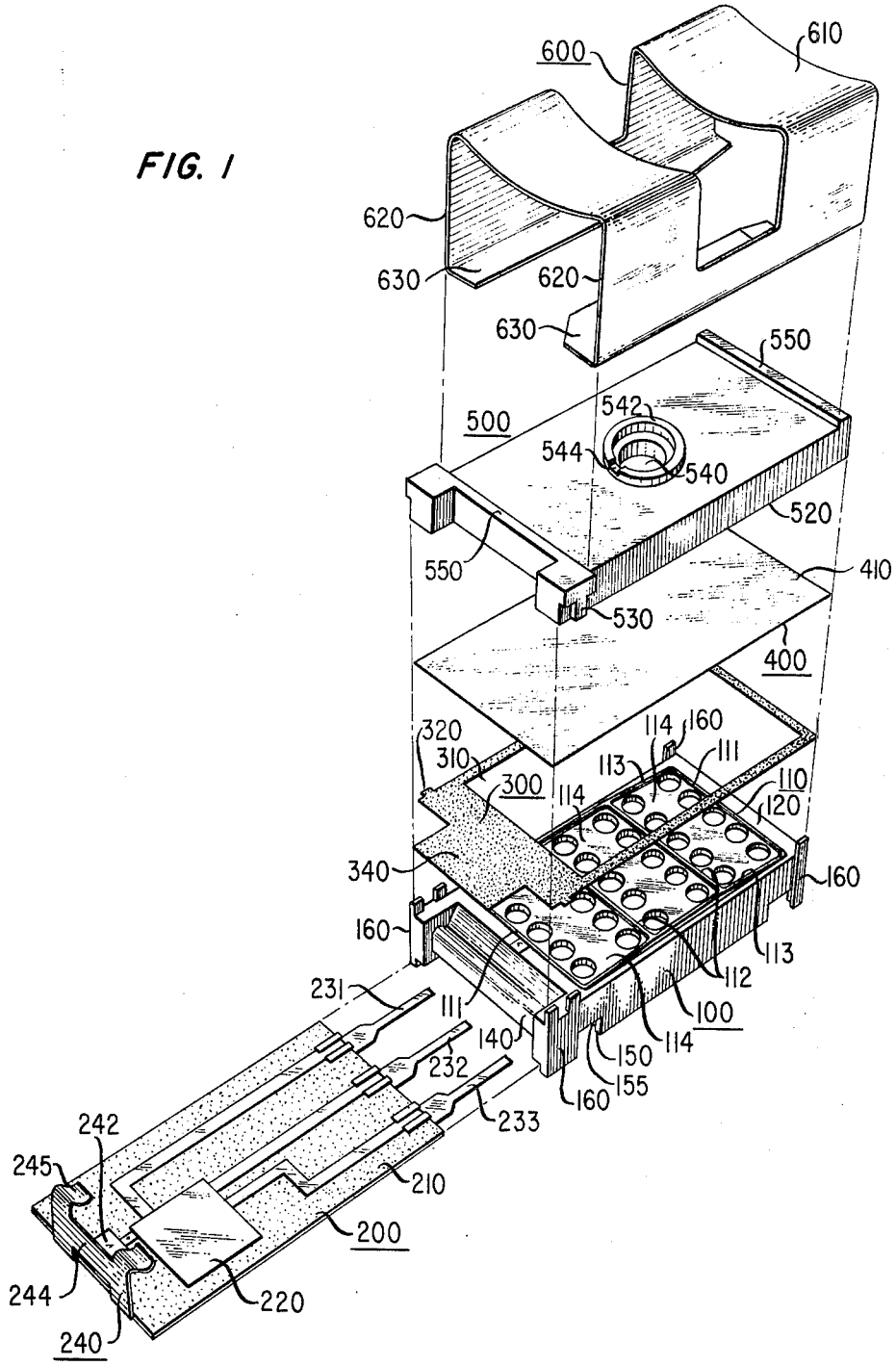
FIG. 1 is an exploded perspective view looking toward the upper surfaces of a spring member, intermediate member, diaphragm, gasket, backplate, and circuit-bearing member that comprise an electret transducer in accordance with the present invention.

Referring to FIG. 1 of the drawing, the electret transducer comprises a molded rectangular dielectric backplate 100 having a raised rectangular capacitive portion 110 surrounded by a flat clamping surface 120. The capacitive portion 110 includes a pair of end cross ribs 111 that extend a first height from the clamping surface 120 and a pair of middle cross ribs 112 that extend about twice the height of the end cross ribs, all of the ribs extending parallel to one another.

The capacitive portion 110 also includes a pair of parallel side ribs 113 that join the top surfaces of the cross ribs 111 and 112 and three nearly equal conductive surfaces 114 that are contained within the cross and side ribs and are recessed a fixed distance from the top surfaces of the ribs. Thus the side ribs 113 and conductive surfaces 114 between the middle cross ribs 112 extend parallel to the clamping surface 120, and the side ribs and conductive surface between each middle cross rib and the adjacent end cross rib are inclined to the clamping surface. The capacitive portion 110 thereby has a generally arcuate profile.

Figure 2:
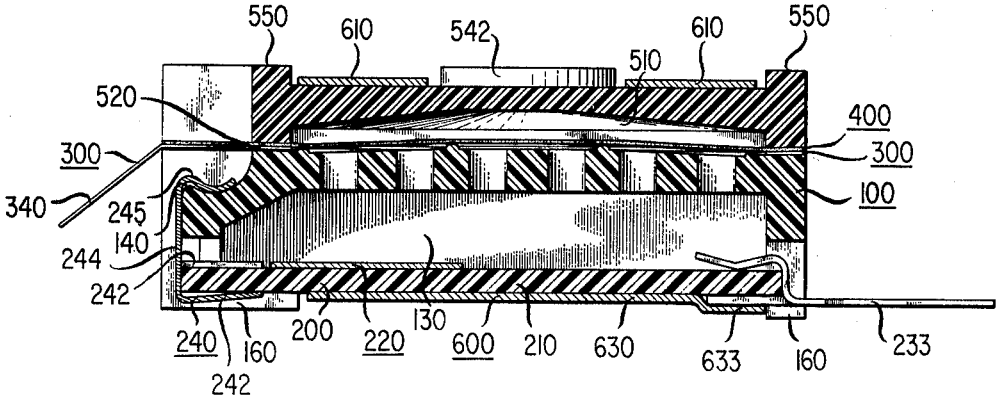
FIG. 2 is a cross-sectional view of the electret transducer taken along line 2—2 of FIG. 3.

Referring also to FIG. 2, an array of holes extends through each conductive surface 114 to an acoustic cavity 130 on the underside of the backplate 100. In addition, the conductive surfaces 114 are electrically interconnected with one another and with a contact surface 140 at one end of the backplate 100 by narrow conductive paths that extend over the cross ribs 111 and 112 and the adjacent end portion of the clamping surface 120. The contact surface 140 is located on a relieved shoulder that is recessed from the adjacent end of the backplate 100, and the contact surface has a generally sine-wave profile in that its height first increases, then decreases, and then increases again.

The backplate 100 further includes guide rails 150 depending from a bottom surface 155 of each side and locating posts 160 at the end of each side. The locating posts 160 all protrude from the sides, extend above the clamping surface 120, and depend below the guide rails 150. The upper ends of the locating posts 160 at the contact portion end of the backplate 100 are notched.

Positioned beneath the backplate 100 is a circuit-bearing member 200 comprising a rectangular substrate 210 having an integrated preamplifier circuit 220 deposited thereon. As seen most clearly in FIG. 4, the length of the substrate 210 is slightly less than that of the backplate 100, and the width of the substrate is such as to be accommodated on the bottom surfaces 155 between the guide rails 150 of the backplate. In addition, as seen most clearly in FIG. 2, the thickness of the substrate 210 is such that when so positioned, the locating posts 160 of the backplate 100 depend below the bottom surface of the substrate.

Turning again to FIG. 1, one end of the substrate 210 has terminal leads 231, 232, and 233 mounted thereon and electrically connected to the circuit 220. Lead 231 is connected to a positive dc voltage supply, lead 232 provides the output signal, and lead 233 is the common or ground terminal. At the other end of the substrate 210, base portion 242 of a contact spring 240 is mounted on the substrate and electrically connected to the input of the preamplifier circuit 220. The contact spring 240 further includes an upright portion 244 that extends generally transverse to the base portion 242 and a bifurcated contact portion 245 that extends generally parallel to the base portion. The contact portion 245 has a similar sine-wave profile to that of the contact surface 140 of the backplate 100.

Referring now also to FIG. 2, the configuration of the contact portion 245 of the contact spring 240 and its spacing from the substrate 210 is such that when the circuit-bearing member 200 is positioned with the substrate 210 on the bottom surfaces 155 between the guide rails 150 of the backplate 100, and with the upright portion 244 of the contact spring within the recess at the end of the backplate, the free end of the contact portion 245 is deflected by and in engagement with the concave portion of the contact surface 140 of the backplate. As a result, the contact spring 240 both (1) provides an electrical connection between the contact surface 140 of the backplate 100 and the input of the preamplifier circuit 220, and (2) holds the substrate 210 against the bottom surfaces 155 of the backplate. Furthermore, the convex portion of the contact surface 140 serves to prevent the contact spring 240 and thereby the substrate 210 from being inadvertently dislodged from this position.

A thin rectangular dielectric gasket 300 is positioned on the clamping surface 120 of the backplate 100, the gasket having an opening 310 through which the capacitive portion 110 of the backplate protrudes. The gasket 300 is of a size to fit within the locating posts 160 of the backplate 100 and includes tabs 320 that are accommodated by the notched locating posts. The portion of the gasket 300 between the tabs 320 overlies the contact portion 245 of the contact spring 240 and the contact surface 140 of the backplate 100. In addition, the gasket 300 has a tongue portion 340 that is adapted to extend along the outside of the upright portion 244 of the contact spring 240. The tongue portion 340 serves to insulate the contact spring 240 from the housing (hereinafter described) enclosing the transducer.

A rectangular electret diaphragm 400 is tensioned longitudinally across the cross ribs 111 and 112 of the capacitive portion 110 of the backplate to form three electret cells in parallel. During the assembly of the transducer this tension is applied by an external force. The width of the diaphragm 400 is approximately the same as the width of the capacitive portion 110 of the backplate 100 and thus the diaphragm is in engagement with both the cross ribs 111 and 112 and the side ribs 113. The length of the diaphragm 400 is such that it overlies the portion of the gasket 300 that rests on the clamping surface 120 at each end of the capacitive portion 110 of the backplate 100. The surface of the diaphragm 400 remote to the backplate 100 is metallized to provide a conductive surface 410.

Positioned over the diaphragm 400 is a molded dielectric rectangular plate-like intermediate member 500, the underside of which includes a rectangular cavity 510 surrounded by a flat, clamping surface 520. The clamping surface 520 is adapted to overlie the clamping surface 120 of the backplate 100; and with the clamping surfaces in juxtaposition with one another, the cavity 510 accomodates the capacitive portion 110 of the backplate and the portion of the diaphragm positioned thereon. The intermediate member 500 is properly oriented with respect to the backplate 100 by the locating posts 160. A pair of T-shaped bosses 530 respectively protrude from the sides of the intermediate member 500 adjacent one end thereof, and the stem portions of the bosses are of a size to fit in the notched locating posts 160, while the sides of the intermediate member are themselves spaced so as to be accommodated between the locating posts.

The intermediate member 500 has an acoustical port 540 that communicates with the center of the cavity 510, the port comprising an upstanding annular entryway 542 having a slot 544 that provides ambient pressure equalization to the acoustic cavity 130. The top surface of the cavity 510 has a generally domed shape and the portion of the cavity between the port 540 and the diaphragm 400 essentially defines the front chamber of the transducer. The surface of the intermediate member 500 is metallized and thus it serves to make an electrical connection with the metallized surface 410 of the diaphragm 400.

Figure 3:
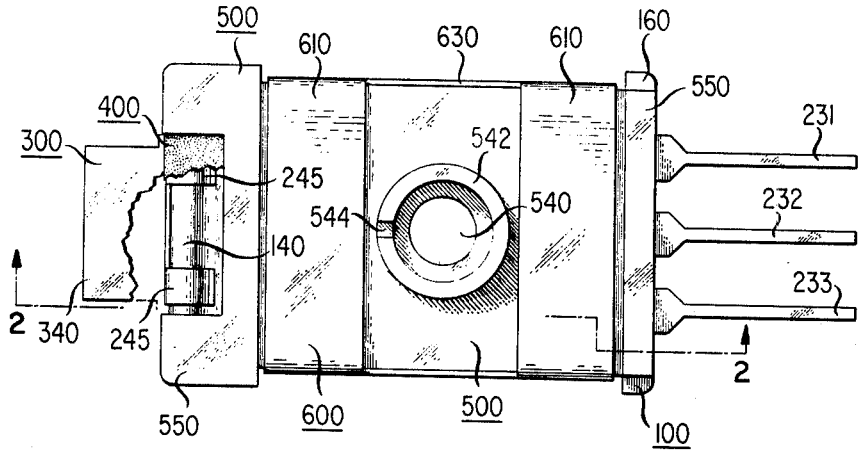
FIG. 3 is a top view of the electret transducer with portions broken away to show the engagement of a contact spring of the circuit-bearing member with a conductive surface of a contact portion of the backplate.
Figure 4:
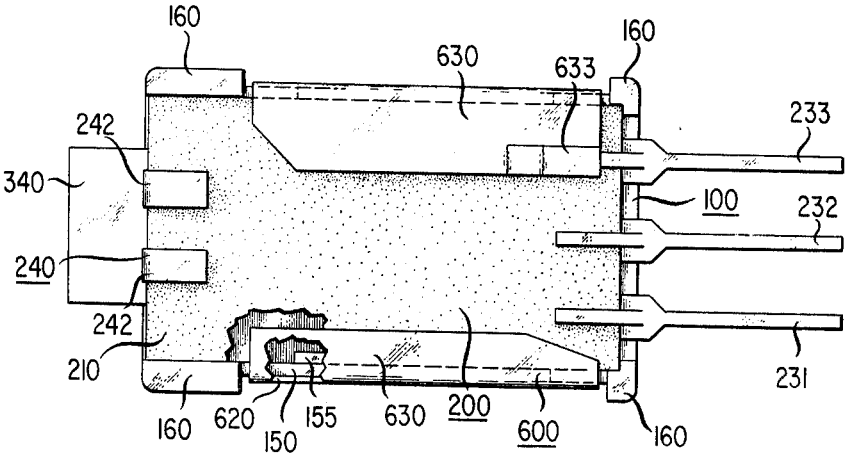
FIG. 4 is a bottom view of the electret transducer with portions broken away to show the interaction between the circuit-bearing member and the underside of the backplate.

Referring now to FIGS. 1, 3, and 4, the upper surface of the intermediate member 500 has a locating ridge 550 at each end thereof that in cooperation with the locating posts 160 of the backplate 100 serve to properly situate a conductive spring member 600 disposed about the foregoing components. The spring member 600 comprises a downwardly bowed top portion 610 that is accomodated between the locating ridges 550 at each end of the intermediate member 500 and straddles the annular entryway 542 in the middle of the intermediate member. The spring member 600 further comprises a pair of parallel side portions 620 that are accommodated between the locating posts 160 at each end of the backplate 100 and a pair of upwardly inclined bottom portions 630 that extend beneath the backplate and engage the underside of the circuit-bearing member 200.

The spring member 600 is configured such that the top portion 610 presses the intermediate member 500 toward the backplate 100 with sufficient force to clamp the ends of the diaphragm 400 between the intermediate member and the underlying portions of the gasket 300. The tension on the diaphragm 400 is thereby retained when the external tensioning force is removed. In addition, the bottom portions 630 press the circuit-bearing member 200 against the bottom surfaces 155 of the backplate 100 and thereby provide additional support for the circuit-bearing member. Furthermore, the bottom portion 630 adjacent to the ground terminal lead 233 of the circuit-bearing member 200 includes a terminal 633 that engages the terminal lead and provides an electrical connection thereto, the terminal being advantageously soldered to the lead. A conductive path is thereby completed from the metallized surface 410 of the diaphragm 400, through the intermediate member 500 and the spring member 600 to the ground terminal lead 233. Finally, because the spring member 600 is connected to the ground terminal lead 233, it provides electrostatic shielding for the electret.

The foregoing assembly is an operative electroacoustic transducer. Therefore the transducer can be tested before it is enclosed within its protective housing and if it is found to be defective, the components are readily accessible for correcting the defect.

Figure 5:
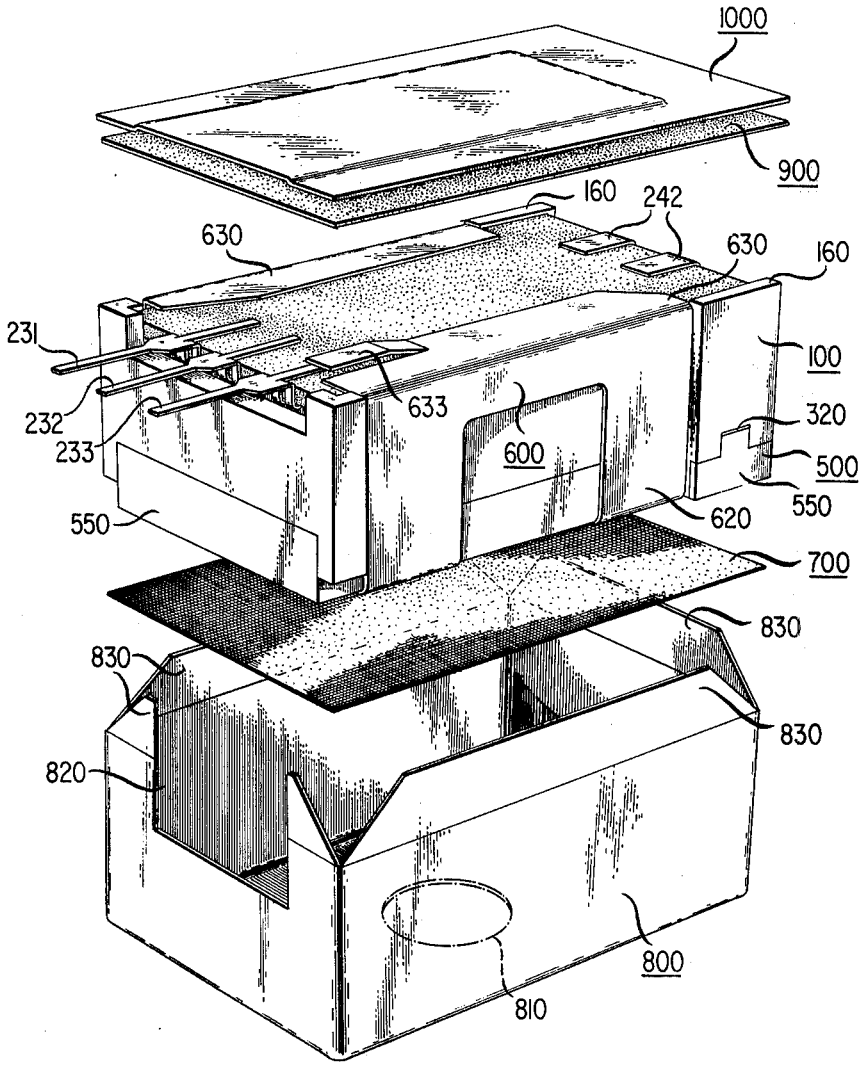
FIG. 5 is an exploded perspective view showing the electret transducer and the components of a housing that encloses it.

Referring now to FIG. 5, the housing comprises a grid screen 700, a container 800, a gasket 900, and a cover 1000. The grid screen 700 provides damping for shaping the acoustic response of the transducer and serves as a barrier to the entry of contaminants into the front chamber of the transducer. The grid screen 700 extends over the top portion 610 of the spring member 600 and rests on both the annular entryway 542 and the locating ridges 550 of the intermediate member 500.

The container 800 is an open-ended, box-like member of a size to accommodate the transducer assembly. The closed end of the container 800 includes an opening 810 located so as to overlie the acoustic portion 540 of the intermediate member 500, while one end wall of the container includes an opening 820 through which the terminal leads 231, 232, and 233 extend. Both the end walls and the side walls of the container 800 include crimping flanges 830 at their extremities.

With the transducer assembly and grid screen 700 positioned within the container 800, the gasket 900 is positioned on the locating posts 160 and the cover 1000 is positioned on the gasket. The crimping flanges 830 of the container 800 are then bent over and swaged against the cover 1000. This presses the grid screen 700 into intimate engagement with both the container 800 and the intermediate member 500. As both the screen 700 and the container 800 are conductive members, a conductive path is established from the container to the ground terminal lead 233. The container 800 and cover 1000 thereby serve to provide an outer electrostatic shield for the transducer. Since the locating posts 160 depend below the underside of the circuit-bearing member 200, no pressure is applied to the substrate 210. This eliminates the possibility of the substrate, which is made of vitreous material, from being shattered either by the swaging operation during assembly or by shocks applied to the transducer while it is in use.

Although a single embodiment of the invention has been shown and described in detail, it is to be expressly understood that the invention is not limited thereto, but is defined by the appended claims. Furthermore, the terms "upper", "beneath", and so forth appearing in the claims are employed to establish relative positions between the elements of the transducer and do not limit the transducer to any particular orientation.

What is claimed is:

1. An electroacoustic transducer comprising:

a backplate having a conductive upper surface electrically interconnected with a contact surface thereof;

a circuit-bearing member positioned beneath the backplate, the circuit-bearing member having a contact spring mounted thereon, the contact spring engaging the contact surface of the backplate to electrically connect the conductive surface to the circuit on the circuit-bearing member and support the circuit-bearing member in place;

a diaphragm juxtaposed with the conductive upper surface of the backplate, the diaphragm having a conductive surface on the side opposite to that facing the backplate;

a conductive intermediate member positioned in engagement with the conductive surface of the diaphragm; and a conductive spring member biasing the intermediate member toward the backplate, the spring member providing a conductive path between the conductive intermediate member and the circuit on the circuit-bearing member, and further support for the circuit-bearing member.

2. An electroacoustic transducer as in claim 1 wherein the diaphragm is tensioned across the backplate, the intermediate member clamps the diaphragm in place, and the spring member provides the clamping force necessary to retain the tension on the diaphragm.

3. An electroacoustic transducer as in claim 1 wherein the transducer is rectangular and the contact surface of the backplate is at one end of the backplate and the spring member is disposed about the sides of the intermediate member, diaphragm, backplate, and circuit-bearing member.

4. An electroacoustic transducer as in claim 1 wherein the spring member includes a terminal that is juxtaposed with and electrically connected to a terminal on the circuit-bearing member.

5. An electroacoustic transducer as in claim 1 wherein the contact spring comprises a base portion that engages the circuit-bearing member and is electrically connected to the circuit thereon, an upright portion extending from and generally transverse to the base portion, and a contact portion extending from the upright portion generally parallel to the base portion, the contact portion engaging the contact surface of the backplate.

6. An electroacoustic transducer as in claim 5 wherein the contact portion of the contact spring has a sine wave-like profile in that the portion immediately adjacent to the upright portion is convex and the portion extending therefrom is concave, the contact surface of the backplate has a similar profile, and the concave portion of the contact spring engages a concave portion of the contact surface.

7. An electroacoustic transducer as in claim 1 wherein the backplate includes a rectangular capacitive portion comprising a pair of spaced parallel side ribs and a plurality of spaced parallel cross ribs extending between and joining the top surfaces of the side ribs, the conductive upper surface of the backplate being recessed from and contained within the ribs, and the diaphragm being tensioned in engagement with both the side and cross ribs.

8. An electroacoustic transducer as in claim 1 wherein the backplate is rectangular and it includes guide rails depending from the bottom surface of each side, and the circuit-bearing member rests on the bottom surface of the sides between the guide rails.

9. An electroacoustic transducer as in claim 1 further including a conductive housing for providing a protective enclosure for the transducer, the housing being electrically connected to the circuit on the circuit-bearing member by the intermediate member and the spring member to provide electrostatic shielding.

10. An electroacoustic transducer as in claim 9 wherein the backplate includes locating portions that depend below the bottom surface of the cirucit-bearing member and space the housing from the circuit-bearing member.

11. An electroacoustic transducer as in claim 10 wherein the housing comprises an open-ended container and a cover for closing the open end of the container, the container being positioned over the spring member, intermediate member, diaphragm, backplate, and circuit-bearing member, the cover being positioned in engagement with the bottom surface of the locating portions of the backplate, and the container being clamped against the cover.

12. An electroacoustic transducer as in claim 1 wherein the spring member comprises a downwardly bowed top portion that engages the intermediate member, a pair of generally parallel side portions that extend along side of the intermediate member, diaphragm, backplate, and circuit-bearing member, and a pair of upwardly inclined bottom portions that extend beneath the backplate and engage the underside of the circuit-bearing member.

* * * * *